US008931917B1

(12) United States Patent
Liu

(10) Patent No.: US 8,931,917 B1
(45) Date of Patent: Jan. 13, 2015

(54) WORK LIGHT FOR MULTI-OCCASIONS

(71) Applicant: Shen-Wei Liu, Taichung (TW)

(72) Inventor: Shen-Wei Liu, Taichung (TW)

( * ) Notice: Subject to any disclaimer, the term of this patent is extended or adjusted under 35 U.S.C. 154(b) by 0 days.

(21) Appl. No.: 14/064,150

(22) Filed: Oct. 27, 2013

(51) Int. Cl.

| | |
|---|---|
| ***F21V 7/20*** | (2006.01) |
| ***F21V 21/096*** | (2006.01) |
| ***F21V 29/00*** | (2006.01) |
| ***F21V 17/08*** | (2006.01) |

(52) U.S. Cl.
CPC ..... *F21V 21/0965* (2013.01); *F21V 29/2206* (2013.01); *F21V 17/08* (2013.01)
USPC ..... 362/218; 362/230

(58) Field of Classification Search
USPC ..... 362/218, 230
See application file for complete search history.

(56) References Cited

U.S. PATENT DOCUMENTS

| | | | | |
|---|---|---|---|---|
| 7,731,386 | B2 * | 6/2010 | Levine | 362/197 |
| 7,959,319 | B2 * | 6/2011 | Chien | 362/230 |
| 2010/0295468 | A1 * | 11/2010 | Pedersen et al. | 315/294 |
| 2012/0236555 | A1 * | 9/2012 | Pedersen et al. | 362/231 |

* cited by examiner

*Primary Examiner* — Mary Ellen Bowman
(74) *Attorney, Agent, or Firm* — Che-Yang Chen; Law Office of Michael Chen

(57) ABSTRACT

A work light for multi-occasions includes a rectangular lamp body, and a radiating surface disposed on a front side for connecting with a power cord. Radially protruded heat dissipating fins and spacedly apart heat dissipating grooves are formed on cross sections besides the radiating surface of the rectangular lamp body. One end cover coupled to one end surface is disposed with a switch for controlling the radiating surface, and another end cover coupled to another end surface is disposed with a power socket. At least one fixing device includes a platy fastener with fastening portions oppositely formed at two ends for slidably fastening in the heat dissipating grooves on an outer wall of the rectangular lamp body. A flexible supporting rod is disposed with coupling portions at two ends for coupling with coupling holes of the fastener and the magnetic fixing element.

6 Claims, 6 Drawing Sheets

WORK LIGHT FOR MULTI-OCCASIONS

BACKGROUND OF THE INVENTION

1. Field of Invention

The present invention relates to a work light for multi-occasions and more particularly to a work light structure that can be fixed conveniently and speedily on any metal materials by magnetism based on lighting requirements for various fixed installations at different angles for different occasions.

2. Related Art

Lighting equipment and the installation locations for various work environments are different. Good lighting environment helps to enhance the work efficiency and reduce the occurrence of accidents and injuries. Some tasks require additional work lights for working in different occasions in order that the tasks can be performed smoothly. Therefore, auxiliary work lights may be needed for various work occasions.

Both TW Patent Publication No.: 439937 Foldable Work Light and 227781 Improved Work Light Free Turning Structure are of fixed structure. In claim 2 of TW Patent Publication No.: 439937 Foldable Work Light, the hook is used for hanging the work light on a horizontal bar. In the abstract of TW Patent Publication No.: 227781 Improved Work Light Free Turning Structure, the teeth clamping portion of the strengthened clamp is inlayed with two plastic pads for clamping on suitable work locations to provide work lighting. Nevertheless, some work sites are limited for use because of the lack of structures for hanging or clamping, which make such fixed type work lights inapplicable and is one of the drawbacks of conventional work lights.

TW Patent Publication No.: 315296 Improved Handheld Rechargeable Work Light Structure is of handheld type. Similar to household flashlights, it has to be carried by hand in work sites for lighting. For mobility and convenience, handheld work lights are equipped with rechargeable batteries. This design requires time for recharging and is therefore inconvenient for use and is another one of the drawbacks of conventional work lights.

SUMMARY OF THE INVENTION

The present invention of a work light for multi-occasions aims to solve the drawback of the applicability of conventional fixed type work lights being limited by lack of fixed structures in work sites, and the inconvenience of requiring time for recharging handheld work lights.

A primary objective of the present invention is to provide a work light for multi-occasions that can be fixedly and conveniently installed on any metal materials by magnetism at different angles.

A secondary objective of the present invention is to provide a work light for multi-occasions which is equipped with power sockets for connecting to an external power source in order to avoid the inconvenience of waiting for recharging.

A work light for multi-occasions of the present invention comprising:

a long hollow rectangular lamp body, a radiating surface being disposed on a front side of the rectangular lamp body for connecting with a power cord, radially protruded heat dissipating fins and spacedly apart heat dissipating grooves being formed on cross sections besides the radiating surface of the rectangular lamp body, two end surfaces of the rectangular lamp body being coupled with two end covers, one of the end covers being disposed with a switch connected to the power cord for controlling the radiating surface; and at least one fixing device comprising a platy fastener with fastening portions oppositely formed at two ends for slidably fastening in the two heat dissipating grooves upwardly and downwardly disposed on an outer wall of the rectangular lamp body, a coupling hole being disposed in a middle section of the fastener, a magnetic fixing element being disposed with a coupling hole corresponding to the fastener, and a flexible supporting rod being disposed with coupling portions at two ends for coupling with the coupling holes of the fastener and the magnetic fixing element.

In one embodiment, the flexible supporting rod is a metal coil rod structure that can be bent and positioned at any angles.

In another embodiment, the other end cover coupled to the other end surface is disposed with a power socket connected with the power cord for an external power source to connect with and provide power.

In a further embodiment, the fastening portions of the fasteners of the two fixing devices are fastened lengthwise in the heat dissipating grooves of the rectangular lamp body, and the two fixing devices and the rectangular lamp body together form two fixed supporting points.

The present invention will become more fully understood by reference to the following detailed description thereof when read in conjunction with the attached drawings.

DETAILED DESCRIPTION OF THE INVENTION

Figure 1:
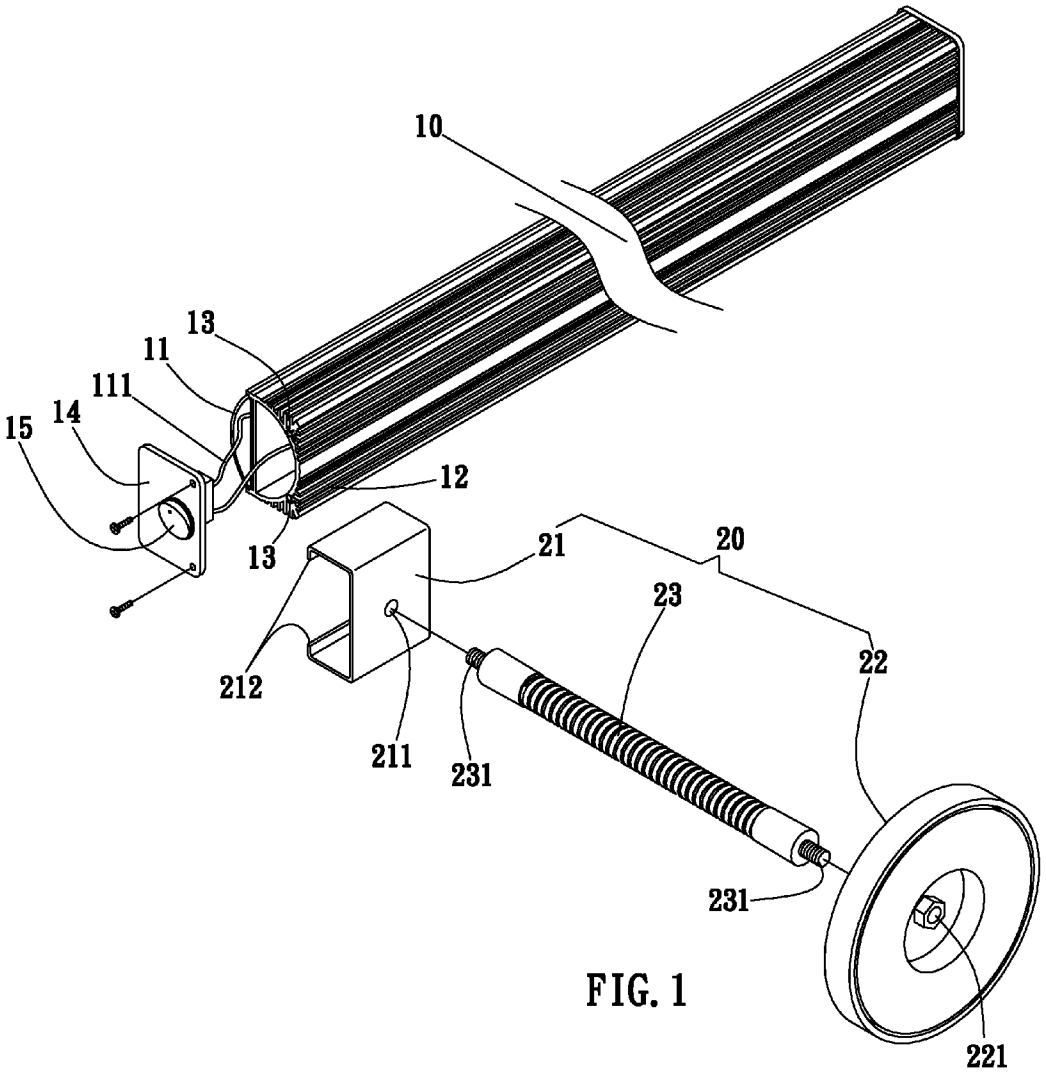
FIG. 1 is a perspective explosive view of a work light for multi-occasions of the present invention.
Figure 2:
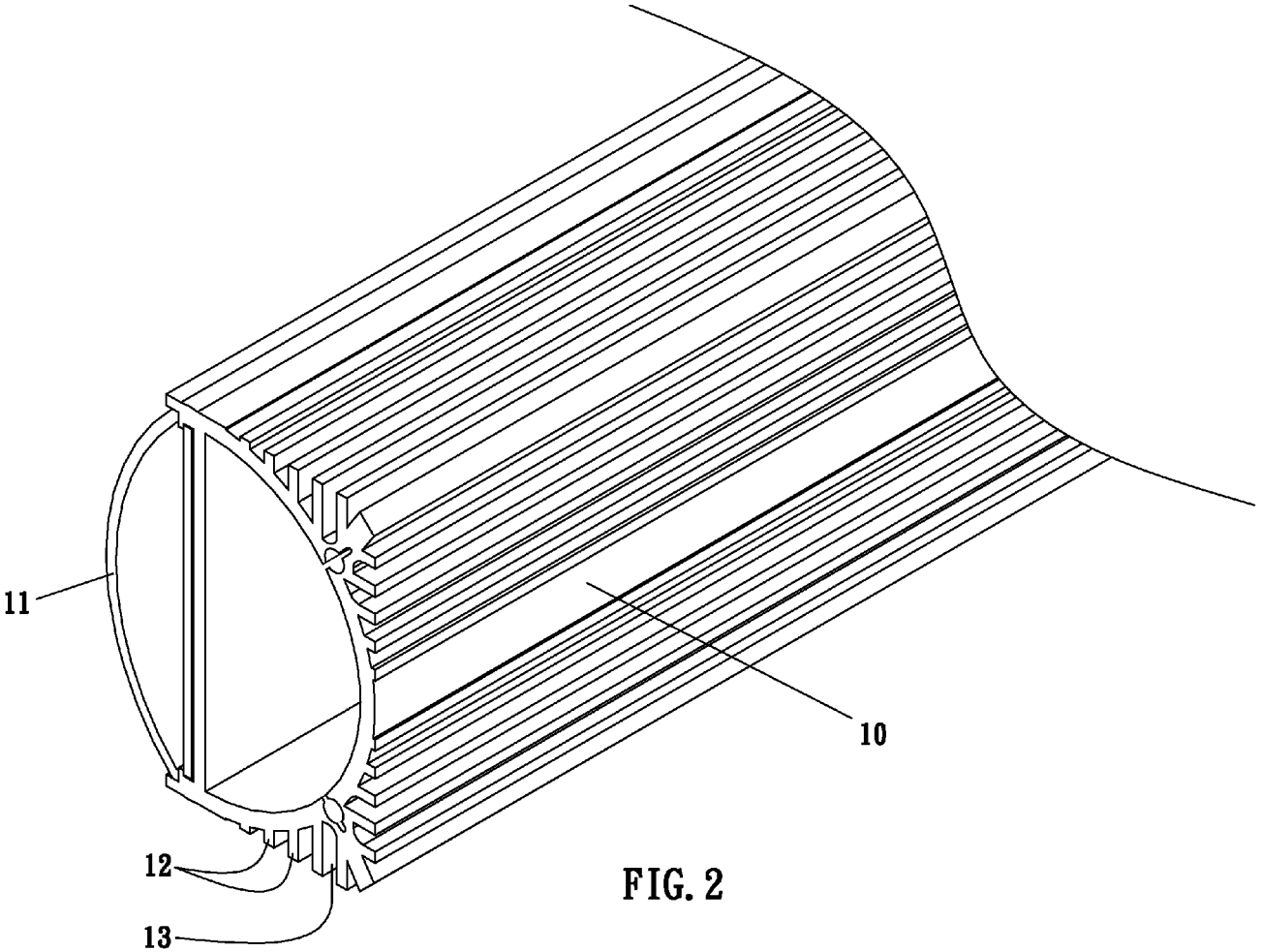
FIG. 2 is a partial enlarged view of an end surface of a rectangular lamp body.
Figure 3:
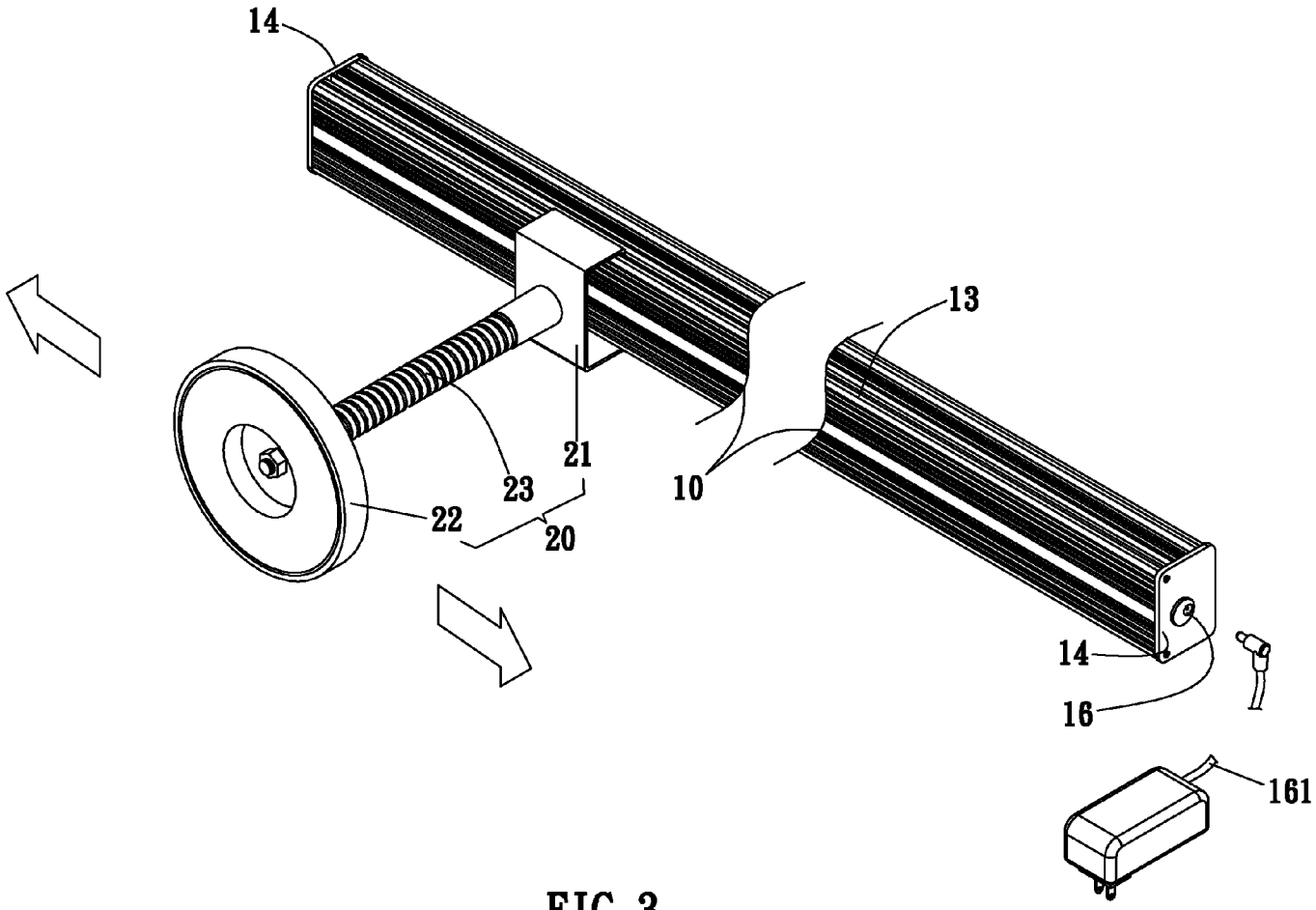
FIG. 3 is a perspective assembly view of the work light for multi-occasions of the present invention.

Please refer to FIGS. 1, 2 and 3; FIGS. 1, 2 and 3 are perspective explosive view of a work light for multi-occasions of the present invention, partial enlarged view of an end surface of a rectangular lamp body and perspective assembly view of the work light for multi-occasions of the present invention respectively. The work light for multi-occasions is composed of a rectangular lamp body 10 and at least one fixing device 20.

Please refer to FIGS. 1 and 2. The rectangular lamp body 10 is a long hollow body, and a radiating surface 11 is disposed on a front side of the rectangular lamp body 10 for connecting with a power cord 111. Radially protruded heat dissipating fins 12 and spacedly apart heat dissipating grooves 13 are formed on cross sections besides the radiating surface 11 of the rectangular lamp body 10. Two end surfaces of the rectangular lamp body 10 are coupled with two end covers 14. One of the end covers 14 is disposed with a switch 15 connected to the power cord 111 for controlling the radiating surface 11. As shown in FIG. 3, the other end cover 14 is disposed with a power socket 16 connected with the power cord 111 for an external power source 161 to connect with and provide power.

The at least one fixing device 20 comprising a platy fastener 21 with fastening portions 212 oppositely formed at two ends for slidably assembling inside the heat dissipating grooves 13 on an outer wall of the rectangular lamp body 10, a coupling hole 211 being disposed in a middle section of the fastener 21; a magnetic fixing element 22 being disposed with a coupling hole 221 corresponding to the fastener 21; and a flexible supporting rod 23 being disposed with coupling portions 231 at two ends for coupling with the coupling holes 211 and 221 of the fastener 21 and the magnetic fixing element 22.

According to the structural assembly mentioned above, the two fastening portions 212 at the two ends of the fastener 21 of the fixing device 20 are inserted, slide and fastened into the two upward and downward oppositely disposed heat dissipating grooves 13 of the rectangular lamp body 10, and are limited from sliding off by the end covers 14 on outer ends of the rectangular lamp body 10. The fixing device 20 can be slidably assembled, clamped and supported at any positions in the heat dissipating grooves 13 between the two end covers 14 of the rectangular lamp body 10 by the fastener 21 as indicated by arrows in FIG. 3.

Figure 4:
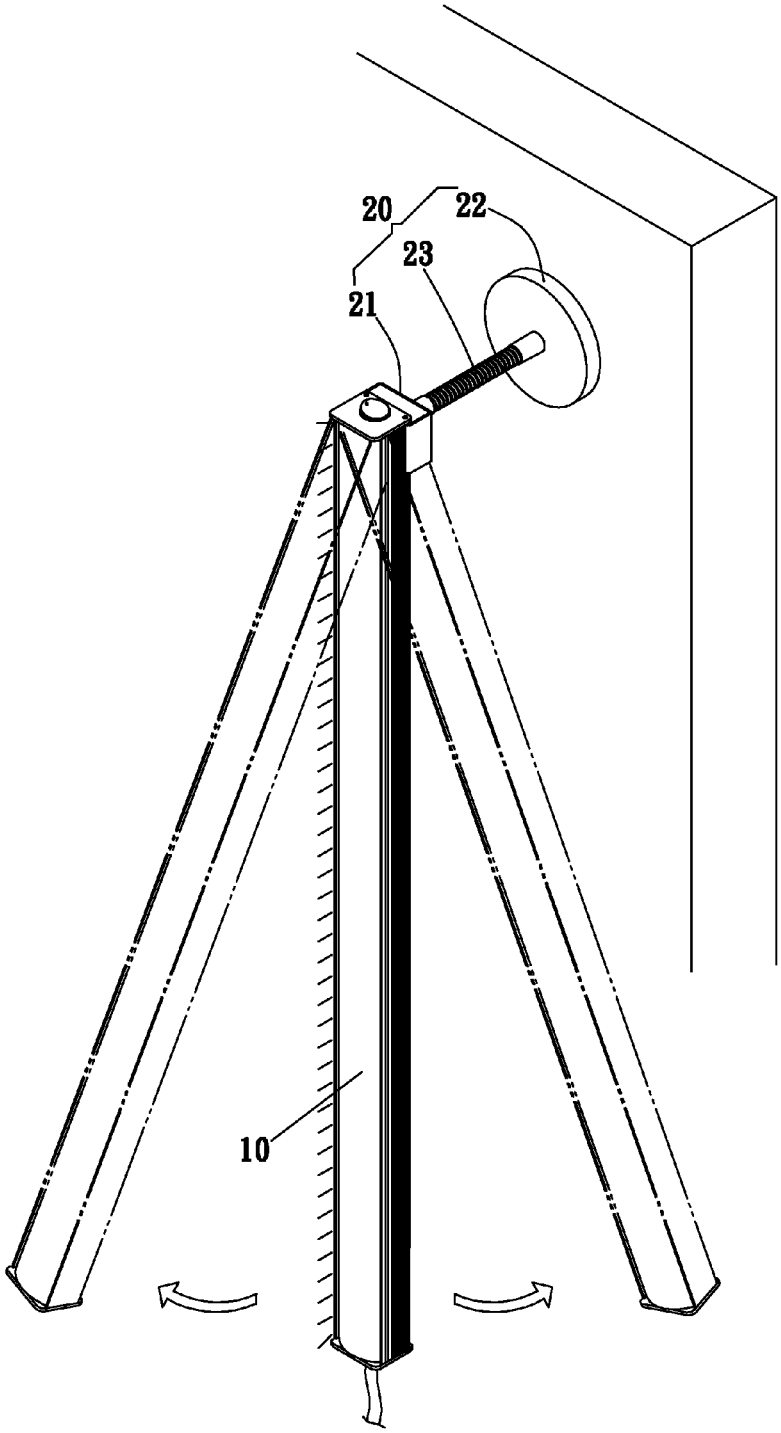
FIG. 4 is a perspective view of the vertically disposed work light for multi-occasions being inclined to the left and right according to an embodiment of the present invention.

FIG. 4 is a perspective view of the vertically disposed work light for multi-occasions being inclined to the left and right according to an embodiment of the present invention. The work light for multi-occasions can be fixed on any metal materials in work sites through the magnetic fixing element 22 of the fixing device 20 by magnetism. The flexible supporting rod 23 supports the rectangular lamp body 10 clamped by the fastener 21 in a vertical position for providing lighting. The rectangular lamp body 10 supported by the flexible supporting rod 23 can be inclined to the left and right to meet various work lighting requirements.

Figure 5:
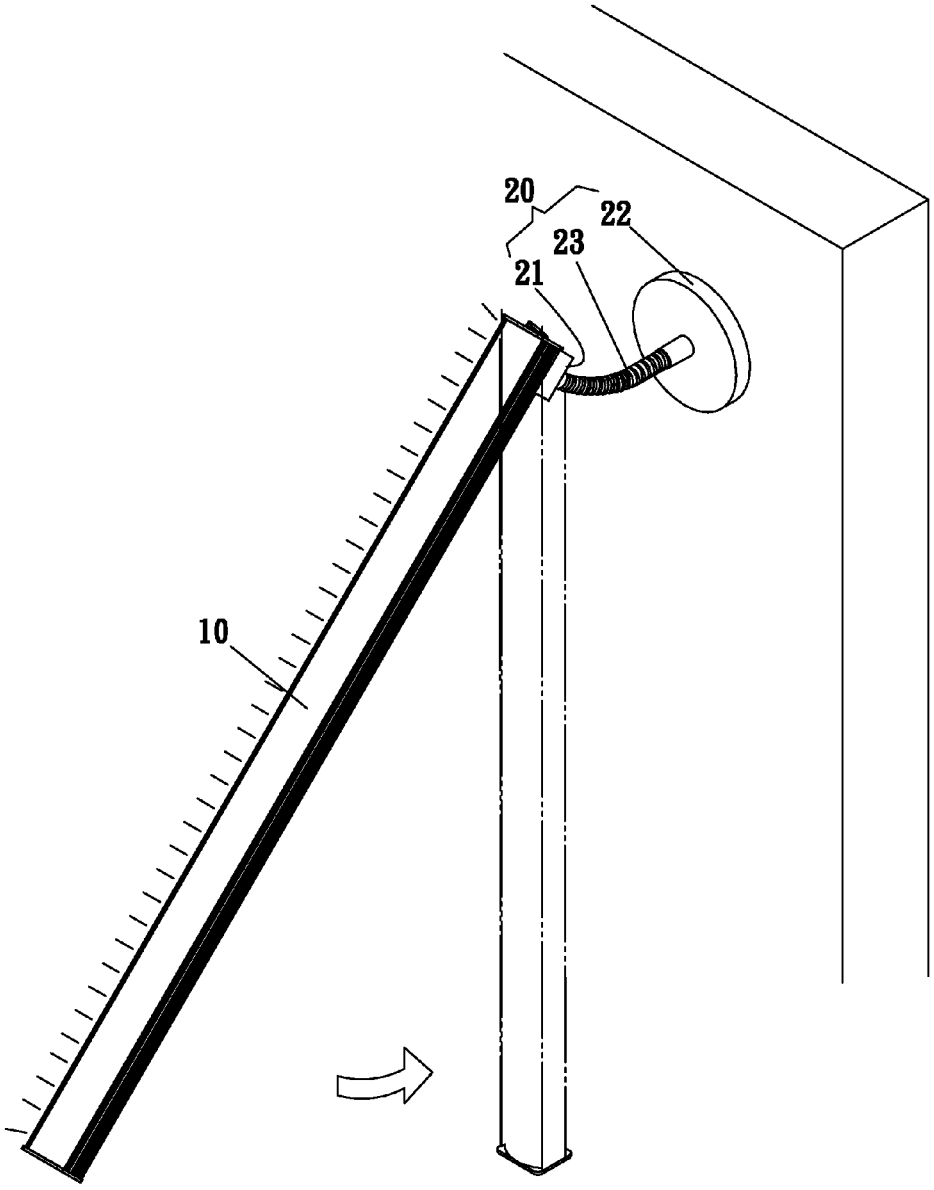
FIG. 5 is a perspective view of the vertically disposed work light for multi-occasions being inclined to the front and back according to an embodiment of the present invention.

FIG. 5 is a perspective view of the vertically disposed work light for multi-occasions being inclined to the front and back according to an embodiment of the present invention. The work light for multi-occasions can be fixed on any metal materials in work sites through the magnetic fixing element 22 of the fixing device 20 by magnetism. The flexible supporting rod 23 supports the rectangular lamp body 10 clamped by the fastener 21 in a vertical position for providing lighting. The rectangular lamp body 10 supported by the flexible supporting rod 23 can be inclined to the front and back to meet various work lighting requirements.

Figure 6:
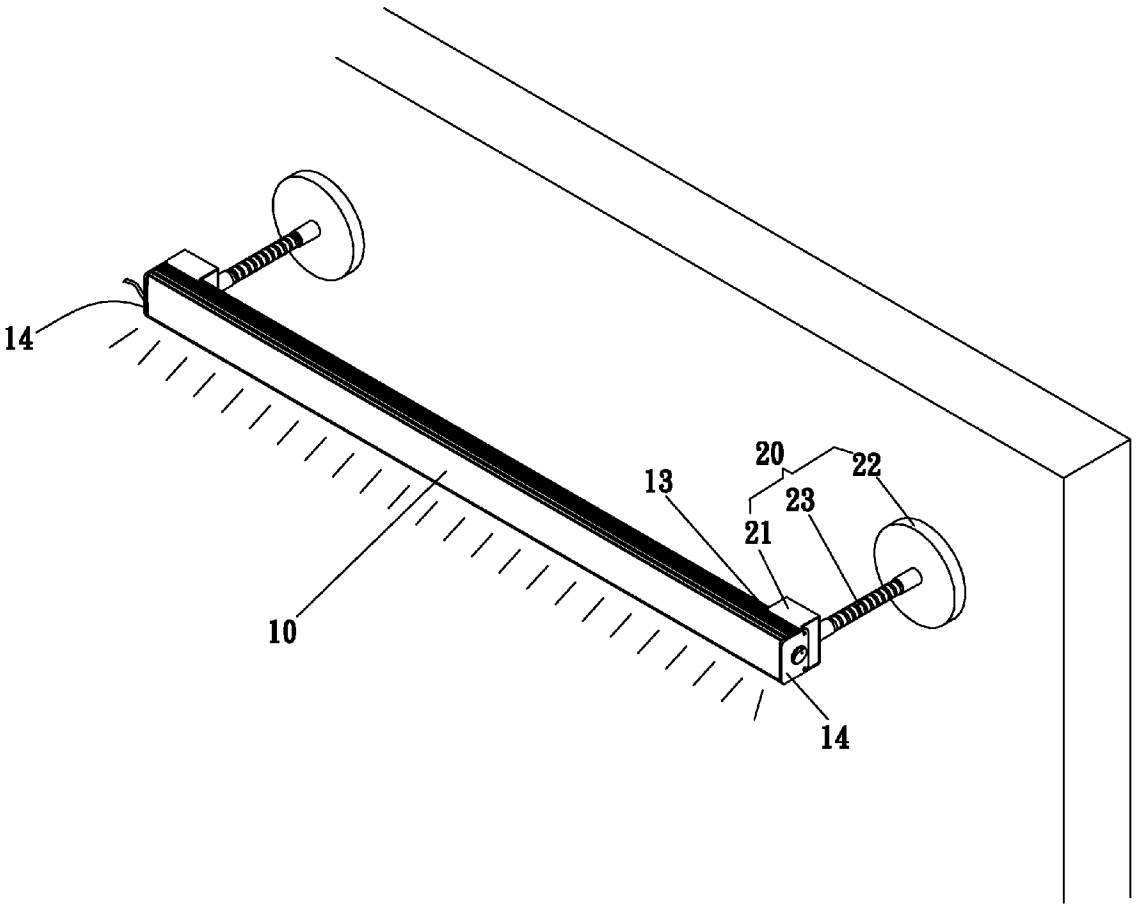
FIG. 6 is a perspective view of the horizontally disposed work light for multi-occasions being fixed by two fixing devices according to an embodiment of the present invention.

FIG. 6 is a perspective view of the horizontally disposed work light for multi-occasions being fixed by the two fixing devices according to an embodiment of the present invention. The fasteners 21 of the two fixing devices 20 can be slidably assembled, clamped and supported in the heat dissipating grooves 13 between the two end covers 14 at the two end surfaces of the rectangular lamp body 10. The two fixing devices 20 and the rectangular lamp body 10 together provide a horizontal support with two fixing points to meet requirements of another work light installation.

The work light for multi-occasions of the present invention can be fixed conveniently and speedily on any metal materials by magnetism by slidably fastening the at least one fixing device in the heat dissipating grooves formed on the cross sections of the work light. The work light for multi-occasions can be fixedly installed at different angles and dispositions for meeting various lighting requirements in different work occasions. The power socket disposed on one of the end covers provides connection for an external power source and therefore the inconvenience of having to wait for recharging can be prevented.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A work light for multi-occasions comprising:

a long hollow rectangular lamp body, a radiating surface being disposed on a front side for connecting with a power cord, radially protruded heat dissipating fins and spacedly apart heat dissipating grooves being formed on cross sections besides the radiating surface of the rectangular lamp body, two end surfaces of the rectangular lamp body being coupled with two end covers, one of the end covers being disposed with a switch connected to the power cord for controlling the radiating surface; and at least one fixing device comprising a platy fastener with fastening portions oppositely formed at two ends for slidably fastening in the two heat dissipating grooves upwardly and downwardly disposed on an outer wall of the rectangular lamp body, a coupling hole being disposed in a middle section of the fastener, a magnetic fixing element being disposed with a coupling hole corresponding to the fastener, and a flexible supporting rod being disposed with coupling portions at two ends for coupling with the coupling holes of the fastener and the magnetic fixing element.

2. The work light for multi-occasions as claimed in claim 1, wherein the flexible supporting rod is a metal coil rod structure that can be bent and positioned at any angles.

3. The work light for multi-occasions as claimed in claim 1, wherein the other end cover coupled to the other end surface is disposed with a power socket connected with the power cord for an external power source to connect with and provide power.

4. The work light for multi-occasions as claimed in claim 1, wherein the fastening portions of the fasteners of the two fixing devices are fastened lengthwise in the heat dissipating grooves of the rectangular lamp body, and the two fixing devices and the rectangular lamp body together form two fixed supporting points.

5. The work light for multi-occasions as claimed in claim 2, wherein the fastening portions of the fasteners of the two fixing devices are fastened lengthwise in the heat dissipating grooves of the rectangular lamp body, and the two fixing devices and the rectangular lamp body together form two fixed supporting points.

6. The work light for multi-occasions as claimed in claim 3, wherein the fastening portions of the fasteners of the two fixing devices are fastened lengthwise in the heat dissipating grooves of the rectangular lamp body, and the two fixing devices and the rectangular lamp body together form two fixed supporting points.

* * * * *